US006183113B1

(12) United States Patent
Waldmann

(10) Patent No.: US 6,183,113 B1
(45) Date of Patent: Feb. 6, 2001

(54) HALOGEN LAMP

(75) Inventor: Gerhard Waldmann, Dauchingen (DE)

(73) Assignee: Herbert Waldmann GmbH Co. (DE)

( * ) Notice: Under 35 U.S.C. 154(b), the term of this patent shall be extended for 0 days.

(21) Appl. No.: 09/240,911

(22) Filed: Jan. 29, 1999

(30) Foreign Application Priority Data

Jan. 31, 1998 (DE) ..... 198 03 882

(51) Int. Cl.[7] ..... F21V 17/00
(52) U.S. Cl. ..... 362/288; 362/263; 362/375
(58) Field of Search ..... 362/263, 288, 362/375

(56) References Cited

U.S. PATENT DOCUMENTS

| | | | | |
|---|---|---|---|---|
| 1,086,303 | * | 2/1914 | Moran | 362/288 |
| 2,804,539 | * | 8/1957 | Robbins | 362/288 |
| 4,414,616 | * | 11/1983 | De Vos et al. | 362/375 |
| 4,450,508 | * | 5/1984 | Carley | 362/375 |
| 5,758,959 | * | 6/1998 | Sieczkowski | 362/288 |
| 5,957,571 | * | 9/1999 | Koster et al. | 362/263 |

FOREIGN PATENT DOCUMENTS

4121575C1 6/1991 (DE) .
2313183 5/1995 (GB) .

* cited by examiner

*Primary Examiner*—Sandra O'Shea
*Assistant Examiner*—Peggy Neils

(57) ABSTRACT

A halogen lamp assembly comprising a housing (12) having a light exit opening (14) and a halogen bulb (28) in the housing, means supporting the halogen bulb (28) so that it can slide axially in the housing (12) and spring means biasing the bulb in the direction of the light exit opening (14) by a clamping ring (18) removably attached to the forward edge (26) of the bulb for pushing the halogen bulb lamp (28) against the force of the spring means (42) into a rear position inside the housing (12), the halogen bulb (28) is pushed by said spring means (42) into a forward position by removal of the clamping ring (18) from the housing (12), wherein its front edge (26) projects out of the housing (12), a socket (30) holds the halogen bulb (28) attached to a socket clip (32), which is supported on two pins (28) so that it can slide in the axial direction of the housing; at least one pin (28) being surrounded by a helical spring means (42), which is held between a rear housing stop (40) and the rear surface of the socket clip (32); and in that the forward position of the halogen bulb (28) is defined by at least one stop (44).

2 Claims, 3 Drawing Sheets

HALOGEN LAMP

BACKGROUND OF THE INVENTION

In known lamps, especially halogen lamps with a small-diameter housing, it is often difficult for the fingers to grip the halogen bulb seated in the housing and to unscrew it from the socket. It can be equally difficult to install a new halogen bulb.

SUMMARY OF THE INVENTION

A rod-shaped lamp with miniature incandescent bulbs for insertion in a motor vehicle is known from German Patent GB 2,313,183. The light exit opening of the lamp is closed off by a lens, which is snap-fitted in the lamp housing. The lens can thus be pulled off the housing, whereupon the incandescent bulb together with its socket and a helical spring which pushes the socket toward the light exit opening can be removed from the housing. The bulb and the various parts can also simply fall out. This can lead to a difficult search and possibly to the loss of individual parts in situations where visibility is poor. When the lens is removed from the housing, which will obviously occur abruptly because of the snap-in fit, the sudden relaxation of the spring can also cause the entire assembly of spring, socket, and bulb to jump out of the housing.

In the case of a halogen lamp in which the bulb is always seated in a reflector, the object of the invention is to provide a device for facilitating the replacement of the bulb but which is also designed reliably to prevent the parts from falling out of the housing when the clamping ring or light exit lens is removed from the housing. Thus, the assembly comprises a housing provided with a light exit opening and a halogen bulb installed in the housing and means supporting the halogen bulb so that it can slide axially in the housing and is biased by spring means biases the bulb in the direction of the light exit opening. The halogen bulb lamp is pushed back against the force of the spring means into a rear position inside the housing by a clamping ring removably attached to the forward edge of the bulb, whereby upon removal of the clamping ring from the housing. The halogen bulb is pushed by said spring means into a forward position wherein its front edge projects out of the housing. A socket holds the halogen bulb attached to a socket clip, which is supported on two pins so that it can slide in the axial direction of the housing. At least one pin being surrounded by a helical spring means, which is held between a rear housing stop and the rear surface of the socket clip. The forward position of the halogen bulb is defined by at least one stop.

Accordingly, when the clamping ring is removed from the housing, the halogen bulb is pushed automatically by the spring or springs toward the front into a forward position precisely defined by one or more stops, in which position it projects out from the forward end of the housing and can be gripped by the hand and removed from its socket. All the internal parts of the lamp are held just as reliably in this forward position as they are in the rear position after the clamping ring has been put back into place. The socket of the bulb is attached to a special socket clip, which is supported in sliding fashion on parallel pins. Upon removal of the clamping ring, the one or two helical springs, which surround the pins, produce the forward movement of the socket clip and thus push the halogen bulb out until it reaches the forward position mentioned above. No special measures for holding the sliding parts in their rear position in the housing after the clamping ring has been put in place are required, because the inside surface of the ring can rest directly against the forward outer edge of the reflector of the halogen bulb.

In accordance with another feature of the present invention, two helical springs and two stops are provided to improve the centering.

In accordance with still another feature of the present invention, the pins are elastic whereby, the elastic deflection of the pins allows the socket clip to bypass the stops so that it can be removed completely from the housing.

BRIEF DESCRIPTION OF THE DRAWINGS

These and other objects of the present invention and various features and details of the operation and construction thereof are hereinafter more fully set forth with reference to the accompanying drawings, wherein.

DESCRIPTION OF THE METHOD AND SYSTEM

Figure 1:
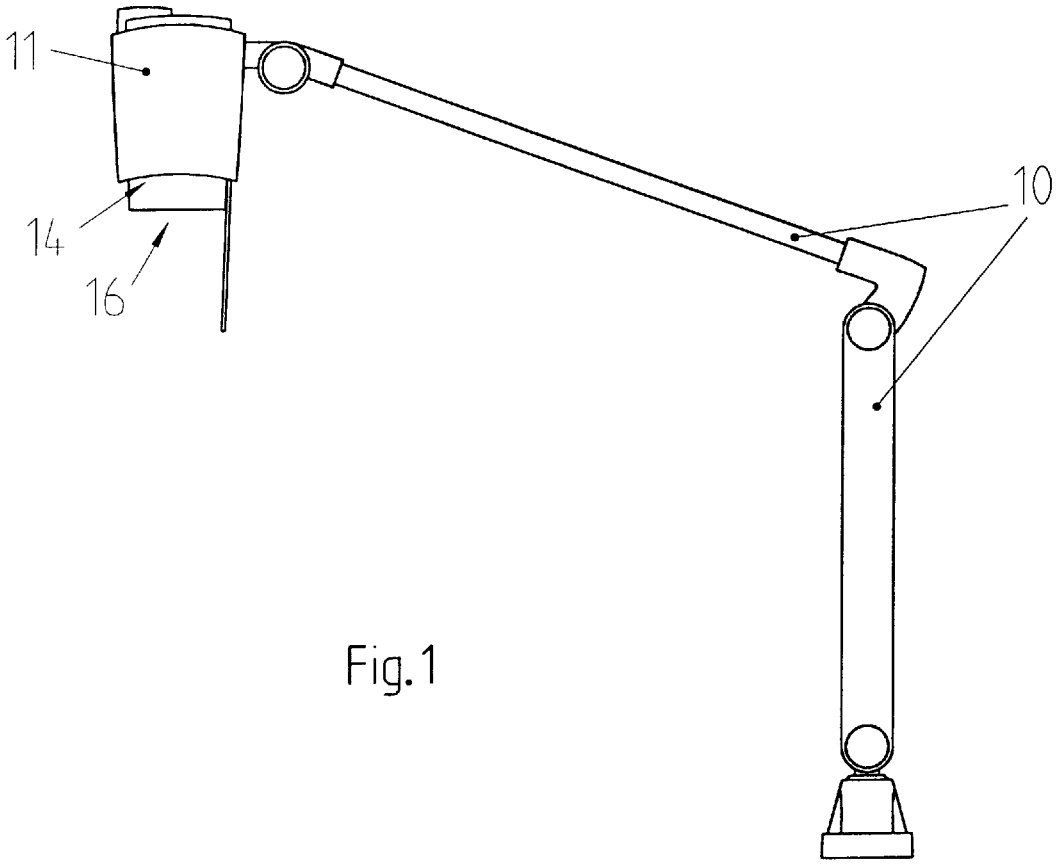
FIG. 1 shows a side view of the overall halogen lamp assembly.
Figure 2:
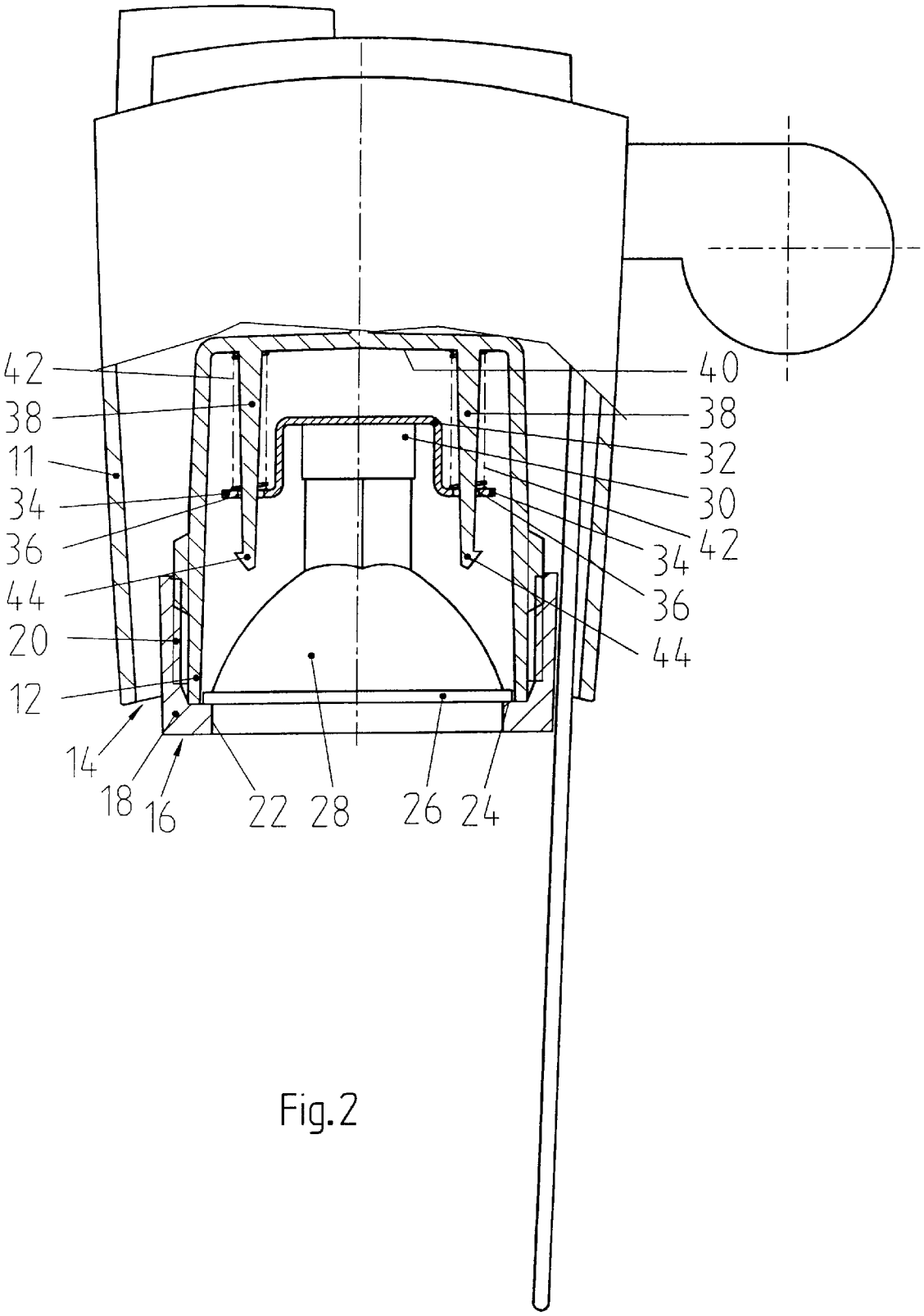
FIG. 2 shows an enlarged and partially cut-away side view of the lamp housing with the bulb in its rear position.

Referring now to the drawings and particularly to FIG. 1, thereof, the halogen lamp assembly shown has a linkage of rods 10 and an external housing 11 supported on the linkage of rods 10. A light exit shield, indicated in general by reference number 16, is mounted in light exit opening 14, situated at the forward end of external housing 11. Light exit shield 16 has a clamping ring 18, which is screwed by means of a thread 20 onto the forward end of the actual housing 12, situated inside external housing 11. A shield disk (not shown) is provided in the front opening 22 of clamping ring 18. The front edge 26 of a halogen bulb 28, which is seated in a bulb socket 30, which in turn is attached to a socket clip 32, rests against edge 24 of clamping ring 18 projecting radially inward into opening 22. Each of the lateral radial arms 34 of socket clip 32 has an opening 36, which slides over a pin 38; the axes of the pins are parallel to each other. A helical spring 42 surrounds each pins 38 and is tensioned between rear floor 40 of housing 12, which forms a stop, and arm 34. As shown in FIG. 2, the action of helical springs 42 causes socket clip 32 and thus halogen bulb 28 to be pushed toward and against the rear surface of edge 24 of clamping ring 18.

Figure 3:
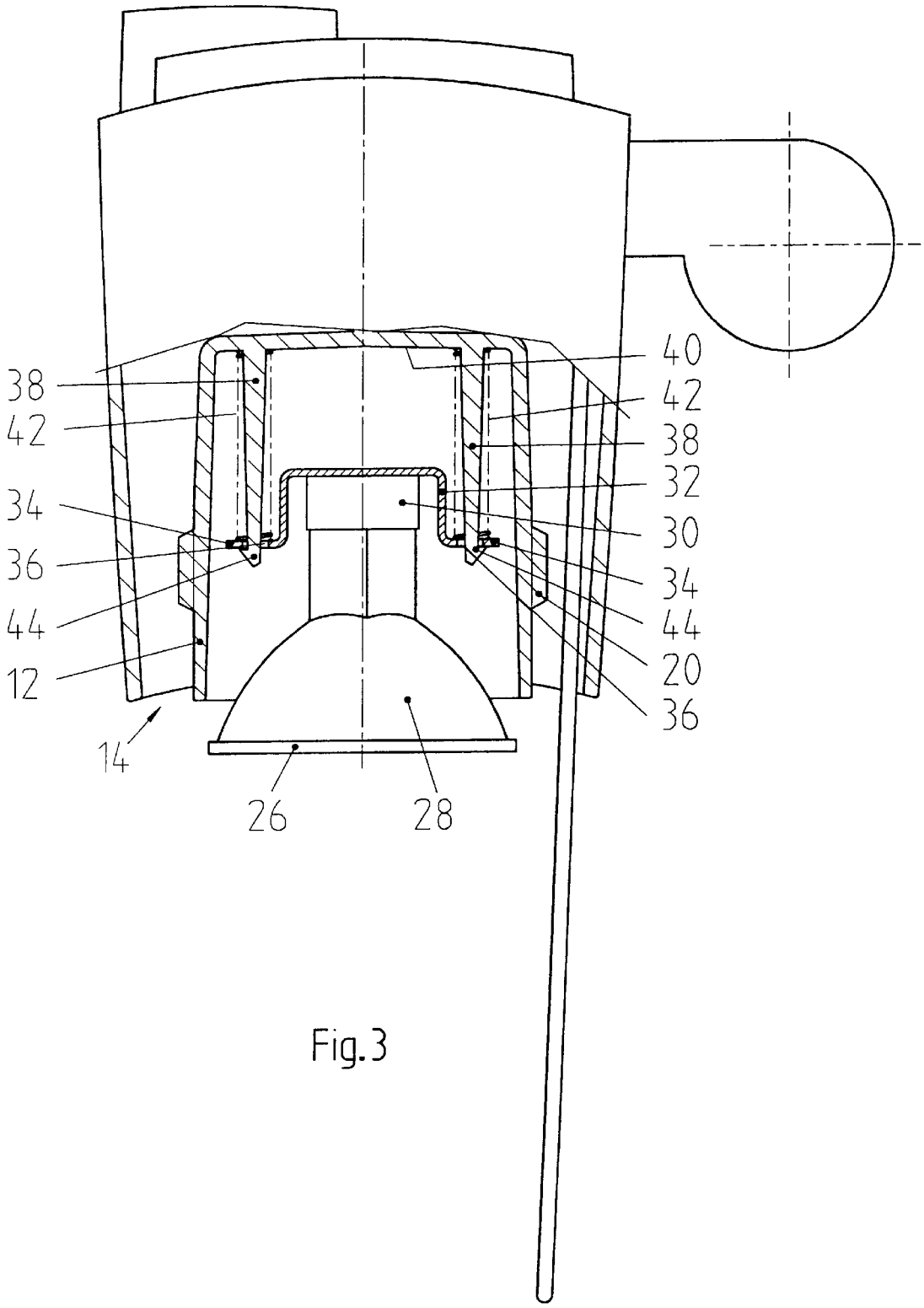
FIG. 3 shows a side view, corresponding to FIG. 2, with the bulb in its forward position.

As soon as clamping ring 18 is unscrewed from housing 12, as can be seen in FIG. 3, the two springs 42 push socket clip 32 with halogen bulb 28 for ward; that halogen bulb 28 thus now projects out of housing 12. In this position, it can be easily gripped by hand and removed from the socket even if the housing is very narrow. The forward-most position of halogen bulb 28 shown in FIG. 3 is defined by hook-shaped stops 44 at the forward end of pins 38; the two arms 34 thus come to rest against these stops 44. Because the two pins 38 have a certain elasticity and because their forward ends are seated with sufficient play in openings 36 in arms 34 of socket clip 32, it is possible to circumvent the position of FIG. 3 by gripping the two stops 44 and pushing them inward, with the result that arms 34 slide by stops 44. Thus it is possible to remove not only halogen bulb 28 but also the entire socket 30 together with socket clip 32 out of housing 12. Socket clip 32 with socket 30 and a possibly new halogen bulb 28 can be reinserted just as easily simply by pushing the arms onto pins 38. The parts are then again in the position of FIG. 3. Finally, clamping ring 18 can be placed onto housing 12, as a result of which the parts of the lamp are returned to the position shown in FIG. 2.

Even though particular embodiments of the present invention have been illustrated and described herein, it is not intended to limit the invention and changes and modifications may be made therein within the scope of the following claims.

What is claimed is:

1. A halogen lamp assembly comprising a housing (12) having a light exit opening (14) and a halogen bulb (28) in the housing, means supporting the halogen bulb (28) so that it can slide axially in the housing (12) and spring means biasing the bulb in the direction of the light exit opening (14) by a clamping ring (18) removably attached to the forward edge (26) of the bulb for pushing the halogen bulb lamp (28) against the force of the spring means (42) into a rear position inside the housing (12), the halogen bulb (28) is pushed by said spring means (42) into a forward position by removal of the clamping ring (18) from the housing (12), wherein its front edge (26) projects out of the housing (12), a socket (30) holds the halogen bulb (28) attached to a socket clip (32), which is supported on two pins (38) so that it can slide in the axial direction of the housing; at least one pin (38) being surrounded by a helical spring means (42), which is held between a rear housing stop (40) and the rear surface of the socket clip (32); and in that the forward position of the halogen bulb (28) is defined by at least one stop (44), said pins (38) being flexible so that when the pins are displaced toward one another, the socket clip (32) can be removed completely.

2. In halogen lamp assembly having a housing (12) with a light exit opening (14) and a halogen bulb (28) having a socket clip mounted in the housing, means supporting the halogen bulb (28) so that it can slide axially in the housing (12) comprising a pair of elongated flexible pins (38) engaging through openings (36) in arms (34) of socket clip (32) and having stop means (44) normally holding said socket clip in place and spring means biasing the bulb in the direction of the light exit opening (14) to a forward position of the halogen bulb (28) defined by said stops (44), flexing of said pins (38) toward one another permitting release of said socket clip (32) from said stop means (44) and complete disengagement of said socket clip (32) from said pins (38).

* * * * *